US005213928A

United States Patent [19]

Yu

[11] Patent Number: 5,213,928

[45] Date of Patent: May 25, 1993

[54] IMAGING MEMBER CONTAINING POLYSILOXANE HOMOPOLYMERS

[75] Inventor: Robert C. U. Yu, Webster, N.Y.

[73] Assignee: Xerox Corporation, Stamford, Conn.

[21] Appl. No.: 787,464

[22] Filed: Nov. 4, 1991

[51] Int. Cl.[5] ..... G03G 5/14

[52] U.S. Cl. ..... 430/66; 430/67; 430/132

[58] Field of Search ..... 430/66, 67, 132

[56] References Cited

U.S. PATENT DOCUMENTS

| | | | |
|---|---|---|---|
| 3,885,965 | 5/1975 | Hughes et al. | 96/48 HD |
| 4,078,927 | 3/1978 | Amidon et al. | 96/1 R |
| 4,218,514 | 8/1980 | Pacansky et al. | 428/450 |
| 4,254,208 | 3/1981 | Tatsuta et al. | 430/215 |
| 4,332,715 | 6/1982 | Ora et al. | 524/265 |
| 4,340,658 | 7/1982 | Inoue et al. | 430/58 |
| 4,388,392 | 6/1983 | Kato et al. | 430/58 |
| 4,469,769 | 9/1984 | Nakazawa et al. | 430/78 |
| 4,474,834 | 10/1984 | Long | 427/209 |
| 4,519,698 | 5/1985 | Kohyama et al. | 355/15 |
| 4,559,261 | 12/1985 | Long | 428/246 |
| 4,560,610 | 12/1985 | Long | 428/246 |
| 4,606,934 | 8/1986 | Lee et al. | 430/67 |
| 4,738,950 | 4/1988 | Vanier et al. | 530/227 |
| 4,784,928 | 11/1988 | Kan et al. | 430/58 |
| 4,923,775 | 5/1990 | Schank | 430/66 |

*Primary Examiner*—John Goodrow

[57] ABSTRACT

An electrostatographic imaging member including a supporting substrate and an outer layer on the imaging side of the imaging member, the outer layer including minute spheres of a high molecular weight polysiloxane homopolymer homogeneously dispersed in a continuous film forming polymer matrix. This imaging member may be used in an electrostatographic imaging process which includes the steps of forming an electrostatic latent image on the imaging surface, developing the electrostatic latent image with marking particles to form marking particle images in conformance with the electrostatic latent image, transferring the marking particles image to a receiving member, cleaning the imaging surface and repeating the electrostatic latent image forming, developing, transferring and cleaning steps at least once. This imaging member is prepared by dissolving the high molecular weight polysiloxane homopolymer and film forming polymer in at least one solvent and forming a dried outer layer in which the high molecular weight polysiloxane homopolymer is phase separated out and homogeneously dispersed as minute spheres in the continuous film forming polymer matrix.

19 Claims, No Drawings

IMAGING MEMBER CONTAINING POLYSILOXANE HOMOPOLYMERS

BACKGROUND OF THE INVENTION

This invention relates in general to electrostatography and, in particular, to an electrostatographic imaging member having an outer imaging layer comprising a high molecular weight polysiloxane dispersed in a film forming polymer matrix.

In electrophotography, an electrophotographic plate containing a photoconductive insulating layer on a conductive layer is imaged by first uniformly electrostatically charging its surface. The plate is then exposed to a pattern of activating electromagnetic radiation such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided toner particles on the surface of the photoconductive insulating layer. The resulting visible image may then be transferred from the electrophotographic plate to a support such as paper. This imaging process may be repeated many times.

An electrophotographic imaging member may be provided in a number of forms. For example, the imaging member may be a homogeneous layer of a single material such as vitreous selenium or it may be a composite layer containing a photoconductor and another material. One type of composite imaging member comprises layer of finely divided particles of a photoconductive inorganic compound dispersed in an electrically insulating organic resin binder. In U.S. Pat. No. 4,265,990, a layered photoreceptor is disclosed having separate photogenerating and charge transport layers. The photogenerating layer is capable of photogenerating holes and injecting the photogenerated holes into the charge transport layer.

Other composite imaging members have been developed having numerous layers which are highly flexible and exhibit predictable electrical characteristics within narrow operating limits to provide excellent images over many thousands of cycles. One type of multilayered photoreceptor that has been employed as a belt in electrophotographic imaging systems comprises a substrate, a conductive layer, a blocking layer, an adhesive layer, a charge generating layer, a charge transport layer and a conductive ground strip layer adjacent to one edge of the imaging layers. This photoreceptor may also comprise additional optional layers such as an anticurl back coating and an overcoating layer.

Electrostatographic imaging members are generally exposed to repetitive electrostatographic cycling which subjects exposed layers thereof to abrasion and leads to a gradual deterioration of the mechanical and electrical characteristics of the exposed layers. For example, repetitive cycling has adverse effects on exposed surface of the outer imaging layer of the imaging member, such as the charge transport layer, charge generating layer, overcoating layer, electrographic imaging layer and the like. When blade cleaning is utilized to remove residual toner particles from the imaging surface of photoreceptors, particles often adhere to the imaging surface and form comet shaped deposits during cycling. These deposits cannot be readily removed by blade cleaning and appear as undesirable defects in the final print output.

It has also been discovered that glue particles from wrappers utilized for packaging copy paper often accumulate on the photoreceptor surface and cannot be readily removed by cleaning blades. These deposits form black spots on the final print output. In addition, paper fibers cling to the imaging surface and cause print-out defects which appear black spots.

Also, the high contact friction which occurs between the cleaning blade and the imaging surface tends to wear both the blade and the imaging surface. Reduction in charge transport layer thickness due to wear increases the electrical field across the layer thereby increasing the dark decay and shortening the electrophotographic service life of the imaging member. Attempts to compensate for wear of the imaging surface by increasing the thickness of charge transport layers cause a decrease in the electrical field which then alters the photoelectric performance and degrades the copy print-out quality which, in turn, require more sophisticated equipment to compensate for the thicker charge transporting layer. Moreover, the change in transport layer thickness as it wears away alters the electrical properties of the photoreceptor and consequently alters the quality of images formed. Attempts have been made to overcome these problems. However, the solution of one problem often leads to additional problems.

INFORMATION DISCLOSURE STATEMENT

U.S. Pat. No. 4,078,927 to Amidon et al., issued Mar. 14, 1978—A planographic printing master is disclosed comprising an ink releasing photoconductive insulating layer and an ink receptive particulate image pattern. The master may be formed from (1) a block copolymer containing polymeric segments from a siloxane monomer and polymeric segments from a non-siloxane monomer and (2) activator compounds, where appropriate (e.g., see line 65, column 3 through line 41, column 4).

U.S. Pat. No. 4,469,764 to Nakazawa et al., issued Sep. 4, 1984—A photosensitive material for electrophotography is disclosed comprising a dispersion of a charge generating pigment in a charge transporting medium composed mainly of a polyvinyl carbazole resin, wherein a specific perylene pigment is dispersed and incorporated as a charge generating pigment and a specific benzoquinone. A leveling agent such as polydimethylsiloxane may be added to improve surface smoothness of the photosensitive layer (e.g., see column 4, lines 66 through 68).

U.S. Pat. No. 4,332,715 to Ona et al., issued Jun. 1, 1982—A vinyl resin composition is disclosed and is obtained by mixing with the vinyl resin a minor portion of an organopolysiloxane which bears one or more acyloxyhydrocarbyl radicals bonded to silicon in the organopolysiloxane.

U.S. Pat. No. 4,784,928 to Kan et al., issued Nov. 15, 1988—An electrophotographic imaging element is disclosed in which image transfer properties are improved by heterogeneously dispersing, as a separate phase within the photoconductive surface layer of the element, finely divided particles of an abhesive substance which is non-conductive and spreadable into which toner particles adhere less strongly than to the composition of the surface layer in the abhesive substance. Various specific materials are disclosed in column 3, lines 1 through 34, including poly(dimethylsiloxane) liquids.

U.S. Pat. No. 4,340,658 to Inoue et al, issued Jul. 20, 1982 and U.S. Pat. No. 4,388,392 to Kato et al, issued Jun. 14, 1983—A photosensitive layer is disclosed in which surface smoothness may be improved by the addition of a leveling agent such as polydimethylsiloxane to a polyvinyl carbazole type photoconductor.

U.S. Pat. No. 4,738,950 to Banier et al., issued Apr. 19, 1988—A dye-donor element is disclosed for thermal dye transfer comprising a support having a one side thereof a dye layer and the other side a slipping layer comprising a lubricating material is disposed in a polymeric binder, the lubricating material comprising a linear or branched aminoakyl-terminated poly-diakyl, diaryl or alkylaryl siloxane.

U.S. Pat. No. 4,254,208 to Tatsuta et al., issued Mar. 3, 1981—A process is disclosed for producing a photographic material comprising dispersing in a solution of organic resin, a material which is incompatible with the organic resin to form a dispersion, coating the resulting dispersion on at least one side of a support to form a coated layer, and then drying the coated layer, the material dispersed being a solid at ordinary temperature and in a liquid phase during the dispersing, whereby the coated layer when dried contains solid particular dispersed therein due to solidification of the dispersed material.

U.S. Pat. No. 4,218,514 to Pacansky et al., issued Aug. 19, 1980—An improved waterless lithographic printing master is disclosed comprising a cross-linked blocked copolymer containing elastic ink releases siloxane blocks chemically linked to organic imaging accepting thermoplastic blocks.

U.S. Pat. No. 3,885,965 to Hughs et al., issued May 27, 1975—A photothermographic element is disclosed comprising a support having thereon a photothermographic layer comprising a photosensitive silver salt, a polymeric, hydrophobic binder and a poly(dimethylsiloxane).

U.S. Pat. No. 4,474,834, U.S. Pat. No. 4,559,261, and U.S. Pat. No. 4,560,610 to Long issued Oct. 2, 1984, Dec. 17, 1985 and Dec. 24, 1985, respectively—A polymer-coated fabric layer is disclosed that is adapted to be secured to a surface of a polymeric product, such as a belt construction. A reduction in the surface coefficient for a belt construction or other product can be achieved by utilizing a layer having opposed surfaces. One layer is adapted to be secured to a surface of a polymeric product and the other is adapted to be a contact face for the product. The two layers of polymeric material are stacked, with only an intermediate polymeric layer initially having a slip agent. The slip agent preferably is a low molecular weight polyethylene.

U.S. Pat. No. 4,519,698 to Kohyama et al—A method is disclosed in which a waxy lubricant is employed to constantly lubricate a cleaning blade.

Copending patent application Ser. No. 07/459,337, filed Dec. 29, 1989—Photoreceptor layers are disclosed containing polydimethylsiloxane copolymers.

Attempts at reducing the frictional damage caused by contact between the cleaning blade and the photosensitive member include adding a lubricant such as wax to the toner. However, the fixability of the toner may degrade its electrical function, or further filming may occur, resulting in a degraded image.

A proposal for reducing frictional force involves applying a lubricant on the surface of the photosensitive drum. In U.S. Pat. No. 4,519,698 to Kohyama et al a method is disclosed in which a waxy lubricant is employed to constantly lubricate a cleaning blade. However, the thickness of the lubricant film formed on the photosensitive drum is difficult to maintain, and interference with the electrostatic characteristics of the photosensitive member occurs.

Attempts have also been made to construct a cleaning blade with a material having a low coefficient of friction. However, these attempts are subject to the problem of degradation in other characteristics, especially mechanical strength, due to the presence of additives.

According to U.S. Pat. No. 4,340,658 to Inoue et al and U.S. Pat. No. 4,388,392 to Kato et al, surface smoothness of a photosensitive layer may be improved by the addition of a leveling agent such as polydimethylsiloxane to a polyvinyl carbazole type photoconductor.

When conventional silicon oil was sprayed onto the imaging surface of a charge transport layer to reduce friction, the charge transport layer cracked when bent, even without cycling.

In copending patent application Ser. No. 07/459,337, filed Dec. 29, 1989 photoreceptor layers are disclosed containing polydimethylsiloxane copolymers. These polydimethylsiloxane block copolymers comprise dimethylsiloxane linked with either a bisphenol carbonate, or a styrene, or an urethane. More specifically, these block copolymers are prepared by linking the backbone of the two types of molecules to form a white, powdery, linear long chain macromolecule. Generally, these block copolymers are miscible in the film forming polymer to form a homogeneous blend without phase separation out from the film forming polymer. However, a relatively low degree of phase separation may be acceptable where the block copolymer has a lower molecular weight than the binder. In this case, the block copolymer may tend to shift upward toward the surface of the charge transport layer, thus enhancing desired surface effects. Typical binders include polycarbonate resin having, for example, a molecular weight of about 120,000. Because of the highly transparent nature of the polydimethylsiloxane block copolymer and film forming polymer coating blend and the surface smoothness of the resulting coating, interference fringes, formed when utilized with laser imaging systems, can appear in the final print images. Because of their appearance these interference fringes are often referred to as "plywood" print defects.

Thus, it is desirable to increase, the durability and extend the life of exposed surfaces in an imaging device as well as to reduce frictional contact between members of the imaging device while maintaining electrical and mechanical integrity.

SUMMARY OF THE INVENTION

It is an object of the invention to provide an imaging member having a reduced coefficient of friction when in contact with the cleaning blades.

It is also an object of the invention to reduce frictional contact between contacting members in an imaging device.

It is another object of the invention to lower the surface energy of the photoreceptor surface to reduce adhesion thereto of desirable materials such as toner, glue and paper fiber particles.

It is yet another object of the invention to enhance cleaning efficiency of the imaging surface of an imaging member.

It is still another object of this invention to provide an imaging member having an improved transport layer that does not adversely affect the electrical properties of the imaging member.

It is another object of the invention to provide an imaging member which improves toner image transfer to receiving members.

It is still another object of this invention to eliminate "plywood" interference fringe print defects.

It is yet another object of the invention to increase tensile cracking resistance of the imaging surface of an imaging member.

The foregoing objects and others are accomplished in accordance with this invention by providing an electrostatographic imaging member comprising a supporting substrate and an outer layer on the imaging side of the imaging member, the outer layer comprising minute spheres of a high molecular weight polysiloxane homopolymer homogeneously dispersed in a continuous film forming polymer matrix. This imaging member may be used in an electrostatographic imaging process which includes the steps of forming an electrostatic latent image on the imaging surface, developing the electrostatic latent image with marking particles to form marking particle images in conformance with the electrostatic latent image, transferring the marking particles image to a receiving member, cleaning the imaging surface and repeating the electrostatic latent image forming, developing, transferring and cleaning steps at least once. This imaging member is prepared by dissolving the high molecular weight polysiloxane homopolymer and film forming polymer in at least one solvent and forming a dried outer layer in which the high molecular weight polysiloxane homopolymer is phase separated out and homogeneously dispersed as minute spheres in the continuous film forming polymer matrix.

All of the high molecular weight polysiloxane homopolymers employed in the outer layers of this invention have a backbone of repeating —Si—O— segments. The high molecular weight polysiloxanes homopolymers may be linear or branched, however, branching should not proceed to the extent that it promotes the formation of a crosslinked network because such crosslinking transforms the polysiloxane from a thermoplastic polymer to a thermoset plastic. Thermoset plastics are insoluble in coating solvents for the outer layer and therefore cannot be applied by solution coating techniques. Any suitable, thermoplastic high molecular weight polysiloxane homopolymer dispersible in a continuous film forming matrix may be utilized in the outer layer of the imaging member of this invention. Typical polysiloxane homopolymers include poly(dialkyl)siloxanes such as poly(dimethyl)siloxane and poly(diethyl)siloxane, poly(methylphenyl)siloxane, poly(diphenyl)siloxane, poly(perfluoroalkyl)siloxane, poly(diglycidoxy)siloxane, poly(vinylbenzyl)siloxane, poly(methylmethacryloxy)siloxane, poly(diaminoalkyl)siloxane, poly(divinylalkyl)siloxane, poly(dichloroalkyl)siloxane, and the like. A generic formula for the thermoplastic high molecular weight polysiloxane homopolymer molecule is shown below:

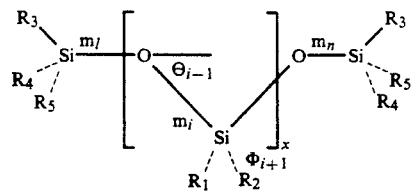

The above is a schematic representation of a high molecular weight, linear polysiloxane homopolymer chain having a degree of polymerization of x+1. The solid heavy lines represent skeletal bonds whereas the dotted lines represent bonds extending out of the plane determined by the chain skeletal atoms. The value of x should be sufficient to form a high molecular weight polymer having a weight average molecular weight between about 200,000 and about 800,000. The characters $m_i$, $m_l$ and $m_n$ indicate the position of the Si—O bonds. The symbol Θ is the angle calculated by subtracting 180° by the Si—O—Si bond angle, and Φ is the rotational angle around the backbone that gives rise to various conformational states. $R_1$ and $R_2$ are each, independently, organic pendent groups of up to 20 and preferably, up to 8, carbon atoms selected from hydrocarbyl, halocarbyl and cyano lower alkyl. $R_3$, $R_4$ and $R_5$ are each, independently, selected from the group consisting of up to 20 and preferably, up to 8, carbon atoms selected from hydrocarbyl and halocarbyl. In the above formula, $R_1$ and $R_2$ can be, for example, mononuclear aryl, such as phenyl, benzyl, tolyl, xylyl and ethylphenyl; halogen-substituted mononuclear aryl, such as 2,6-dichlorophenyl, 4-bromophenyl, 2,5-difluorophenyl, 2,4,6-trichlorophenyl and 2,5-dibromophenyl; alkyl such as methyl, ethyl, n-propyl, isopropyl, n-butyl, sec-butyl, isobutyl, terbutyl, amyl, hexyl, heptyl, octyl, octadecyl; alkenyl such as vinyl, allyl, n-butenyl-1, n-butenyl-2, n-pentenyl-2, n-hexenyl-2,2,3-dimethylbutenyl-2, n-heptenyl; alkynyl such as propargyl, 2-butynyl; haloalkyl such as chloromethyl, iodomethyl, bromomethyl, fluoromethyl, chloroethyl, iodoethyl, bromoethyl, fluoroethyl, trichloromethyl, di-iodoethyl, tribromomethyl, trifluoromethyl, dichloroethyl, chloro-n-propyl, bromo-n-propyl, iodoisopropyl, bromo-n-butyl, bromo-tert-butyl, 1,3,3-trichlorobbutyl, 1,3,3-tribromobutyl, chloropentyl, bromopentyl, 2,3-dichloropentyl, 3,3-dibromopentyl, chlorohexyl, bromohexyl, 1,4-dichlorohexyl, 3,3-dibromohexyl, bromooctyl; haloalkenyl such as chlorovinyl, bromovinyl, chloroallyl, bromoallyl, 3-chloro-n-butenyl-1, 3-chloro-n-pentyl-1, 3-fluoro-n-heptenyl-1, 1,3,3-trichloro-n-heptenyl-5, 1,3,5-tri-chloro-n-octenyl-6, 2,3,3-trichloromethylpentenyl-4; haloalkynyl such as chloropropargyl, bromopropargyl cycloalkyl, cycloalkenyl and alkyl and halogen substituted cycloalkyl and cycloalkenyl such as cyclopentyl, cyclohexyl, cycloheptyl, cyclooctyl, 6-methylcyclohexyl, 3,3-dichlorocyclohexyl, 2,6-dibromocycloheptyl, 1-cyclopentenyl, 3-methyl-1-cyclopentenyl, 3,4-dimethyl-1-cyclopentenyl, 5-methyl-5-cyclopentenyl, 3,4-dichloro-5-cyclopentenyl, 5-(ter-butyl)1-cyclopentenyl, 1-cyclohexenyl, 3-methyl-1-cyclohexenyl, 3-4-dimethyl-1-cyclohexenyl; and cyano lower alkyl such as cyanomethyl, beta-cyanoethyl, gamma-cyanopropyl, delt-cyanobutyl, and gamma-cyanoisobutyl, glycidoxy; methacryloxy; benzyl; and the like. Examples of combinations of $R_1$ and $R_2$ groups include dimethyl, diethyl, diphenyl, methyl phenyl, methyl ethyl, methyl octadecyl, ditetrachlorophenyl, dipentafluoroethyl, methylpentafluoroethyl, diperfluorohexyl, methylperfluorohexyl, and the like. Examples of $R_3$, $R_4$ and $R_5$ include mononuclear aryl, such as phenyl, benzyl, tolyl, xylyl and ethylphenyl; halogen-substituted mononuclear aryl, such as 2,6-dichlorophenyl, 4-bromophenyl, 2,5-difluorophenyl, 2,4,6-trichlorophenyl and 2,5-dibromophenyl; alkyl groups such as methyl, ethyl, n-propyl, isopropyl, n-butyl, sec-butyl, isobutyl, terbutyl, amyl, hexyl, heptyl, octyl; haloalkyl such as chloromethyl, iodomethyl, bromomethyl, fluoromethyl, chloroethyl, iodoethyl, bromoethyl, fluoroethyl, trichloromethyl, diiodoethyl, tribromomethyl, trifluoromethyl, dichloroethyl, and the like.

A specific example of a segment of a high molecular weight poly(dimethyl)siloxane homopolymer is represented by the following formula:

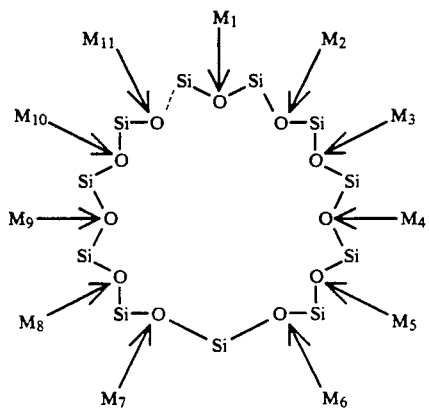

This schematic representation shows a segment of a linear polysiloxane homopolymer chain backbone in an all-trans conformation, having a degree of polymerization of 11. The arrows represent group dipoles M for each Si—O—Si pair of bonds, and the bond angles about Si and O atoms are taken to be 110° and 143°, respectively. Because of the differences in the Si and O bond angles, the linear molecule will form a helical or coiled structure at molecular weights where the degree of polymerization is greater than 11.

The expression "high molecular weight" as employed herein is defined as a polysiloxane molecular weight sufficient to cause the linear polysiloxane to behave as a pseudo solid. More specifically, the high molecular weight polysiloxane homopolymer has physical characteristics including texture similar to that of plumber's putty, modeling clay or a gummy solid. Thus, this material retains its shape when undisturbed at room temperature. However, its shape may be readily changed with the application of mild pressure. For example, a depression can be made into its surface by merely pressing it with a finger. This characteristic ensures dissolving in a suitable solvent and the formation of a dispersion in the film forming polymer matrix upon drying of the final layer. Unlike polysiloxane fluids, the addition of this polysiloxane homopolymer pseudo solid will enable the formation of the polysiloxane dispersion in the dried imaging layer and prevent migration and bleeding of the polysiloxane out of the outer layer of the imaging member during image cycling. Migration and bleeding is undesirable because the electrical properties of the imaging member can change due to the change in relative proportions of materials in the imaging surface of the outer layer, particularly charge generating or charge transport layers. Further, migration and bleeding of liquid polysiloxanes causes contamination of members that contact the imaging surface of the outer surface such as toner particles, carrier particles and cleaning blades. Generally, the high molecular weight polysiloxane homopolymers have a weight average molecular weight of between about 200,000 and about 800,000. When the molecular weight of the polysiloxane homopolymer is less than about 200,000, the material will lose its pseudo solid characteristics and become a fluid. Ultra high molecular weight polysiloxane homopolymers having a molecular weight greater than about 800,000 are very difficult to synthesize. If the polysiloxane exists in a liquid form, it will migrate or bleed from the imaging surface causing contamination of the imaging subsystems and the effectiveness of cleaning blade removal of toner particles is adversely affected. Moreover, contamination of toner particles with the bleeding liquid polysiloxane can prevent the toner particles from fusing together and to receiving members such as paper during the fusing operation.

Satisfactory results may be obtain when the outer layer comprises between about 0.1 percent and about 10 percent by weight polysiloxane homopolymer based on the total weight of the outer layer. Preferably, the high molecular weight polysiloxane is present in an amount between about 0.5 percent and about 7 percent by weight based on the total weight of the outer layer. Optimum results are achieved with between about 1 percent and about 5 percent by weight polysiloxane based on the total weight of the outer layer. When the proportion of polysiloxane increases beyond about 10 percent by weight, the desired mechanical properties will be unduly degraded and the imaging performance of the imaging member can be adversely affected as well. For example, when the outer layer is a charge transport layer, the imaging characteristics of the imaging member begins to deteriorate due to an increase in electrical cycle-up when the loading level of the high molecular weight polysiloxane homopolymer exceeds about 10 percent by weight. Also, the cohesion of the outer layer is affected by the presence of large amounts of polysiloxane in this layer. This change in cohesion may be identified by a reduction in Young's modulus ultimate tensile strength and percent elongation at break. Further, no additional advantages are achieved by the presence of greater amounts of high molecular weight polysiloxane.

The minute spheres of a high molecular weight polysiloxane homopolymer dispersed in a continuous film forming polymer matrix preferably have an average size between about 0.1 and about 6 micrometers. Optimum results are achieved when the average particle size of the spheres is between about 0.2 micrometer and about 4 micrometers. Satisfactory results may be achieved when the average particle size of the spheres is between about 0.05 micrometer and about 10 micrometers. When the average size of the spheres is greater than about 10 micrometers, the large spheres may cause the formation of dark spots in the copy print out. The minute spheres adjacent the outer surface of the outer layer partially protrude from the outer layer and cause the outer surface to develop a textured topography. Generally, these small spheres protrude to distance of between about 0.01 micrometer and about 0.1 micrometer above the outer surface of the dried outer layer. The textured surface enhances cleaning effectiveness, blade life and mechanical wear life of the imaging member.

Any suitable film forming polymer may be employed in the outer layer. Typical film forming polymers include, for example, various resin binders known for this purpose including, for example, polyesters, polycarbonates such as bisphenol polycarbonates, polyamides, polystyrene, polyacrylate, polyurethanes, polyethercarbonates obtained from the condensation of N,N'-diphenyl-N,N'-bis(3-hydroxy phenyl)-[1,1'-biphenyl]-4,4'-diamine and diethylene glycol bischloroformate and the like. Other film forming polymers that may be employed in the outer layer are described below with reference to specific types of layers.

The outer layer coating composition is prepared by dissolving at least the high molecular weight polysiloxane and film forming polymer in one or more suitable solvents. Any suitable solvent or combination of solvents may be employed to dissolve the polysiloxane and film forming polymer. The polysiloxane, film forming polymer and solvent should be compatible with each other and any other component applied to form the outer imaging layer. The solvent may be a single common solvent that dissolves both the polysiloxane and film forming polymer or a mixture of solvents that are soluble in each other. With the latter embodiment involving a combination of solvents, one of the solvents may more readily dissolve the film forming polymer and the other solvent may more readily dissolve the polysiloxane. Typical solvents for polysiloxanes include, for example, methylene chloride, 1,1,1-trichloroethane, 1,1,2-trichloroethane, 1,1,2-trichloroethylene, normal hexane, cyclohexane, benzene, tetrahydrofuran, toluene, n-octylacetate, n-hexadecane, 2,4-dichlorotoluene, and the like and mixtures thereof. Typical solvents for film forming polymers include, for example, methylene chloride, 1,1,1-trichloroethane, 1,1,2-trichloroethane, 1,1,2-trichloroethylene, normal hexane, benzene, tetrahydrofuran, toluene, and the like and mixtures thereof.

The outer layer coating may be applied by any suitable technique. Typical coating techniques include, spray coating, draw bar coating, brush coating, extrusion, dip coating, roll coating, wire wound rod coating, and the like. Drying of the deposited coating may be effected by any suitable conventional technique such as oven drying, infra red radiation drying, air drying and the like.

Electrostatographic imaging members are well known in the art. Typical electrostatographic imaging members include, for example, photoreceptors for electrophotographic imaging systems and electroceptors or ionographic members for electrographic imaging systems.

The high molecular weight polysiloxane material may be used in any suitable outer layer of an electrostatographic imaging member, for example, in a charge transport layer, a single photoconductive layer photoreceptor, a ground strip layer, an electrographic imaging layer, a protective overcoating layer and the like, if any of these layers is an outer layer on the imaging side of an imaging member.

The supporting substrate may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or an organic composition. As electrically non-conducting materials, there may be employed various resin binders known for this purpose including polyesters, polycarbonates such as bisphenol polycarbonates, polyamides, polyurethanes, polystyrenes and the like. The electrically insulating or conductive substrate may be rigid or flexible and may have any number of different configurations such as, for example, a cylinder, a sheet, a scroll, an endless flexible belt, and the like. Preferably, the substrate is in the form of an endless flexible belt and comprises a commercially available biaxially oriented polyester known as Mylar, available from E. I. du Pont de Nemours & Co., or Melinex, available from ICI Americas Inc. or Hostaphan, available from American Hoechst Corporation.

The thickness of the substrate depends on numerous factors, including beam strength and economical considerations, and thus this layer for a flexible belt may be of substantial thickness, for example, about 125 micrometers, or of minimum thickness of no less than 50 micrometers, provided there are no adverse effects on the final electrostatographic device. In flexible belt embodiments, the thickness of this layer ranges from about 65 micrometers to about 150 micrometers, and preferably from about 75 micrometers to about 100 micrometers for optimum flexibility and minimum stretch when cycled around small diameter rollers, e.g. 19 millimeter diameter rollers.

The conductive surface of the supporting substrate may comprise an electrically conductive material that extends through the thickness of the substrate or may comprise a layer or coating of electrically conducting material on a self supporting material. The conductive layer may vary in thickness over substantially wide ranges depending on the degree of optical transparency and flexibility desired for the electrostatographic imaging member. Accordingly, for a flexible imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. The conductive layer need not be limited to metals.

A hole blocking layer may be applied to the conductive surface of the substrate for photoreceptors. Generally, electron blocking layers for positively charged photoreceptors allow holes from the imaging surface of the photoreceptor to migrate toward the conductive layer. Any suitable blocking layer capable of forming an electronic barrier to permit hole migration between the adjacent photoconductive layer and the underlying conductive layer may be utilized. For negative charging photoreceptors, hole blocking layers are usually interposed between the photoconductive or charge generating layer and electrically conductive layer to prevent hole injection. The hole blocking layer may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethyl-ethylamino)titanate, titanium-4-amino benzene sulfonat oxyacetate, titanium 4-aminobenzoate isostearate oxyacetate, $[H_2N(CH_2)_4]CH_3Si(OCH_3)_2$ (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,291,110, 4,338,387, 4,286,033 and 4,291,110. The disclosures of U.S. Pat. Nos. 4,338,387, 4,286,033 and 4,291,110 are incorporated herein in their entirety. A preferred hole blocking layer comprises a reaction product between a hydrolyzed silane and the oxidized surface of a metal ground plane layer. The oxidized surface inherently forms on the outer surface of most metal ground plane layers when exposed to air after vacuum deposition. The hole blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. The hole blocking layer should be continuous and have a thickness of less than about 0.2 micrometer after drying because greater thicknesses may lead to undesirably high residual voltage.

An optional adhesive layer may applied to the blocking layer. Any suitable adhesive layer well known in the art may be utilized. Typical adhesive layer materials include, for example, polyesters, duPont 49,000 (available from E. I. duPont de Nemours and Company), Vitel PE100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture over the hole blocking layer include spraying, dip coating, extrusion coating, roll coating, wire wound rod coating, gravure coating, Bird applicator coating, and the like. Drying of the deposited coating may be effected by any suitable conventional technique such as oven drying, infra red radiation drying, air drying, vacuum drying and the like.

Any suitable photogenerating layer may then be applied to the adhesive layer which can then be overcoated with a contiguous hole transport layer as described hereinafter or these layers may be applied in reverse order. Examples of typical photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from DuPont under the tradename Monastral Red, Monastral violet and Monastral Red Y, Vat orange 1 and Vat orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired. Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infra-red light.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, extrusion coating, and the like. Drying of the deposited coating may be effected by any suitable conventional technique such as oven drying, infra red radiation drying, air drying, vacuum drying and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in the multilayered photoconductor of this invention comprises from about 25 percent to about 75 percent by weight of at least one charge transporting aromatic amine compound, and about 75 percent to about 25 percent by weight of a polymeric film forming resin in which the aromatic amine is soluble.

The charge transport layer forming mixture preferably comprises an aromatic amine compound of one or more compounds having the general formula:

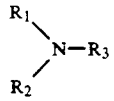

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as $NO_2$ groups, CN groups, and the like.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane, 4'-4''-bis(diethylamino)-2',2''-dimethytriphenylmethane, N,N,'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyether carbonate, polyvinylcarbazole, polyester, polyarylate, polyacrylate, polyether, polysulfone, and the like. Molecular weights can vary from about 20,000 to about 150,000.

Any suitable and conventional technique may be utilized to mix and thereafter apply the charge transport layer coating mixture to the charge generating layer. Typical application techniques include spraying, extrusion coating, dip coating, roll coating, wire wound rod coating, and the like. Drying of the deposited coating may be effected by any suitable conventional technique such as oven drying, infra red radiation drying, air drying and the like.

Generally, the thickness of the hole transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

The preferred electrically inactive resin materials are polycarbonate resins have a molecular weight from about 20,000 to about 150,000, more preferably from about 50,000 to about 120,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 120,000, available as Makrolon from Farbenfabricken Bayer A. G. and a polycarbonate resin having a molecular weight of from about 20,000 to about 50,000 available as Merlon from Mobay Chemical Company. Methylene chloride solvent is a desirable component of the charge transport layer coating mixture for adequate dissolving of all the components and for its low boiling point.

Examples of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507. The disclosures of these patents are incorporated herein in their entirety. The photoreceptors may comprise, for example, a charge generator layer sandwiched between a conductive surface and a charge transport layer as described above or a charge transport layer sandwiched between a conductive surface and a charge generator layer.

An especially preferred multilayered photoconductor comprises a charge generating layer comprising a photoconductive material and a contiguous hole transport layer of a film forming binder and an electrically active small molecule. a polycarbonate resin material having a molecular weight of fro about 20,000 to about 120,000 having dispersed therein from about 25 to about 75 percent by weight of one or more compounds having the general formula:

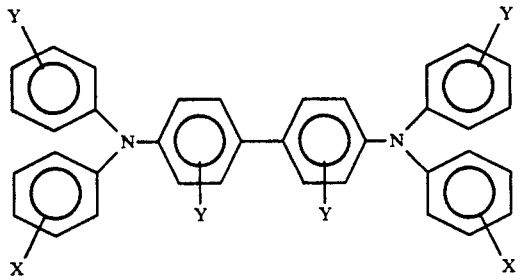

wherein X is selected from the group consisting of an alkyl group, having from 1 to about 4 carbon atoms, and Y is H or a alkyl group having 1–4 carbon atoms.

In multilayered photoreceptors, the photoconductive charge generating layer should exhibit the capability of photogeneration of holes an injection of the holes, the charge transport layer being substantially non-absorbing in the spectral region at which the photoconductive layer generates and injects photogenerated holes but being capable of supporting the injection of photogenerated hole from the photoconductive layer and transporting the holes through the hole transport layer. If the photoconductive layer or charge generating layer is the outer layer in the imaging member of this invention, it can contain the homogeneously dispersed high molecular weight polysiloxane homopolymer of this invention.

Other layers such as a conventional electrically conductive ground strip located adjacent to the charge transport layer along one edge of the belt in contact with the conductive layer, blocking layer, adhesive layer or charge generating layer to facilitate connection of the electrically conductive layer of the photoreceptor to ground or to an electrical bias. The ground strip layer comprises a film forming polymer binder and electrically conductive particles. Any suitable electrically conductive particles may be used in the electrically conductive ground strip layer. The ground strip may comprise materials which include those enumerated in U.S. Pat. No. 4,664,995, the disclosure thereof being incorporated herein in its entirety. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized. The ground strip layer may have a thickness from about 7 micrometers to about 42 micrometers, and preferably from about 14 micrometers to about 27 micrometers. Since the ground strip can be an outer layer in the imaging member of this invention, it can contain the high molecular weight polysiloxane of this invention. However, not all imaging members utilize a ground strip. If a ground strip is present, it may be present as an outer layer along with and adjacent to other outer layers which may be a film forming polymer containing charge generating layer, charge transport layer, overcoating layer or dielectric layer. If the ground strip is present on the imaging member as an outer layer, either the ground strip or the adjacent outer layer or both the ground strip and the adjacent outer layer may contain the homogeneously dispersed high molecular weight polysiloxane homopolymer of this invention.

If an overcoat layer comprising a film forming polymer binder is employed, it will be an outer layer to which the high molecular weight polysiloxane may be added. Overcoatings without a high molecular weight polysiloxane are well known in the art and are either electrically insulating or slightly semi-conductive. When overcoatings are employed on the imaging member of this invention, it should be continuous. The overcoating layer may range in thickness from about 2 micrometers to about 8 micrometers, and preferably from about 3 micrometers to about 6 micrometers. An optimum range of thickness is from about 3 micrometers to about 5 micrometers.

In some cases an anti-curl back coating may be applied to the side opposite the imaging side of the imaging member to enhance flatness and/or abrasion resistance. The anti-curl back coating layers are well known in the art and may comprise film forming polymers that are electrically insulating or slightly semi-conductive. Examples of film forming resins include polyacrylate, polystyrene, bisphenol polycarbonate, poly(4,4'-isopropylidene diphenyl carbonate), 4,4'-cyclohexylidene diphenyl polycarbonate, and the like. An adhesion promoter additive may also be used. Usually from about 1 to about 15 weight percent of adhesion promoter is added to the anti-curl back layer. Typical adhesion promoters additives include 49,000 (available from E. I. du Pont de Nemours & Co.), Vitel PE-100, Vitel PE-200, Vitel PE-307 (Goodyear Chemical), and the like. The thickness of the anti-curl layer is preferably between about 3 micrometers and about 35 micrometers.

For electrographic imaging members, a flexible dielectric layer overlying the conductive layer may be substituted for the photoconductive layers. Any suitable, conventional, flexible, electrically insulating dielectric film forming polymer may be used in the dielectric layer of the electrographic imaging member. These dielectric layers may contain the homogeneously dispersed high molecular weight polysiloxane homopolymer, if the dielectric layers are the outer layer on the imaging side of electrographic imaging members.

The high molecular weight polysiloxane additive of this invention is nontoxic, inert, resistant to ultraviolet light, does not degrade or otherwise adversely affect electrical properties of the outer layer, and improves the wear resistance and frictional properties of the outer layer.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A control photoconductive imaging member was prepared by providing a titanium coated polyester (Melinex 442 available from ICI Americas Inc.) substrate having a thickness of 3 mils, and applying thereto, using a gravure applicator, a solution containing 50 grams 3-amino-propyltriethoxysilane, 15 grams acetic acid, 684.8 grams of 200 proof denatured alcohol and 200 grams heptane. This layer was then dried for 10 minutes at 135° C. in a forced air oven. The resulting blocking layer had a dry thickness of 0.05 micrometer.

An adhesive interface layer was then prepared by applying a wet coating over the blocking layer, using a gravure applicator, containing 0.5 percent by weight based on the total weight of the solution of polyester adhesive (DuPont 49,000, available from E. I. du Pont de Nemours & Co.) in a 70:30 volume ratio mixture of tetrahydrofuran/cyclohexanone. The adhesive interface layer was then dried for 5 minutes at 135° C. in a forced air oven. The resulting adhesive thickness of 0.05 micrometer.

The adhesive interface layer was thereafter coated with a photogenerating layer containing 7.5 percent by volume trigonal selenium, 25 percent by volume N,N'-diphenyl-N,N'-bis(3-methyl-phenyl)-1,1'-biphenyl-4,4'-diamine, and 67.5 percent by volume polyvinylcarbazole. This photogenerating layer was prepared by introducing 80 grams polyvinylcarbazole to 1400 ml of a 1:1 volume ratio of a mixture of tetrahydrofuran and toluene. To this solution was added 80 grams of trigonal selenium and 10,000 grams of ⅛ inch diameter stainless steel shot. This mixture was then placed on a ball mill for 72 to 96 hours. Subsequently, 500 grams of the resulting slurry were added to a solution of 36 grams of polyvinylcarbazole and 20 grams of N,N'-diphenyl-N,N'-bis(3-methyl-phenyl)-1,1'-biphenyl-4,4'-diamine in 750 ml of 1:1 volume ratio of tetrahydrofuran/toluene. This slurry was then placed on a shaker for 10 minutes. The resulting slurry was thereafter applied to the adhesive interface with an extrusion die to form a layer having a wet thickness of about 0.5 mil. However, a strip about 3 mm wide along one edge of the substrate, blocking layer and adhesive layer was deliberately left uncoated by any of the photogenerating layer material to facilitate adequate electrical contact by the ground strip layer that was applied later. This photogenerating layer was dried at 135° C. for 5 minutes in a forced air oven to form a photogenerating layer having a dry thickness of 2.3 micrometers.

This member was then coated over with a charge transport layer. The charge transport coating solution was prepared by introducing into an amber glass bottle in a weight ratio of 1:1 N,N'-diphenyl-N,N'-bis(3-methylphenyl)-1,1'-biphenyl-4,4'-diamine, and the binder resin Makrolon 5705, a polycarbonate having a weight average molecular weight from about 50,000 to about 120,000, available from Farbenfabricken Bayer AG. The resulting mixture was dissolved in methylene chloride to provide a 15 weight percent solution thereof. This solution was then applied onto the photogenerator layer with a 3 mil gap Bird applicator to form a wet charge transport layer. During this coating process the relative humidity was maintained at about 14 percent. The fabricated photoconductive member was then annealed at 135° C. in a forced air oven for 5 minutes to produce a 24 micrometers dry thickness charge transport layer. The resulting dried outer coating was smooth, clear and transparent.

EXAMPLE II

A photoconductive imaging member having two electrically operative layers as described in Control Example I was prepared using the same procedures and materials except that a charge transport layer of the invention was used in place of the charge transport layer of Control Example I. The charge transport layer solution of the invention was prepared by dissolving 74.25 grams of Makrolon and 74.25 grams of N,N'-diphenyl-N,N'-bis(3-methylphenyl)-1,1'-biphenyl-4,4'-diamine in 850 grams of methylene chloride, followed by the addition of 1.5 grams of high molecular weight poly(dimethylsiloxane) to the solution. With the use of a high speed stirrer for good mixing, the poly(dimethylsiloxane) was dissolved to form the charge transport layer solution. The poly(dimethylsiloxane) was a pseudo solid available from Dow Corning Corporation. It had a molecular weight of approximately 500,000, a surface energy of 20 dynes/cm, and a glass transition temperature of about −123° C. The schematic representation of the poly(dimethylsiloxane) chain is shown in the two structures presented above in the detailed discussion of the high molecular weight polysiloxane additives of this invention.

The resulting charge transport layer solution containing the high molecular weight poly(dimethylsiloxane) additive of this invention was then applied onto the charge generating layer using a 3 mil gap Bird applicator. The fabricated imaging device bearing the wet coating was dried at 135° C. for 5 minutes in a forced air oven to give a 24 micrometers dry thickness charge transport layer containing 1 weight percent of poly(dimethylsiloxane) based on the total weight of the dried charge transport layer. Since the dissolved poly(dimethylsiloxane) precipitated out (or phase separated) from the matrix polymer to form small spheres of about 1 to 2 micrometers in size, the resulting charge transport layer was clear and transparent and had textured surface morphology. Partial protrusion of small spheres of poly(dimethylsiloxane) to an average height of about 0.05 micrometer above the outer surface of the dried charge transport gave the outer surface a texture resembling sandpaper when viewed with magnification.

EXAMPLE III

A control photoconductive imaging member having two electrically operative layers as described in Control Example I was prepared using the same procedures and materials except that a charge transport layer of the invention was used in place of the charge transport layer of Control Example I. The charge transport layer solution of the invention was prepared by dissolving 74.25 grams of Makrolon and 74.25 grams of N,N'-diphenyl-N,N'-bis(3-methylphenyl)-1,1'-biphenyl-4,4'-diamine in 850 grams of methylene chloride, followed by the addition of 1.5 grams of low molecular weight polydimethylsiloxane-polycarbonate block copolymer to the solution. With the use of a high speed stirrer for good mixing, the polydimethylsiloxane-polycarbonate block copolymer was dissolved to form the charge transport layer solution. The polydimethylsiloxane-polycarbonate block copolymer was a white powder (PS099, available from Petrarch Systems, Inc.). It had a molecular weight of approximately 5,000 and a surface energy of about 31 dynes/cm.

The resulting charge transport layer solution containing the low molecular weight polydimethylsiloxane-polycarbonate block copolymer was then applied onto the charge generating layer using a 3 mil gap Bird applicator. The fabricated imaging device bearing the wet coating was dried at 135° C. for five minutes in a forced air oven to give a 24 micrometers dry thickness charge transport layer containing 1 percent by weight polydimethylsiloxane-polycarbonate block copolymer based on the total weight of the dried charge transport layer. The dissolved polydimethylsiloxane-polycarbonate block copolymer blended with the matrix polymer and did not precipitate out (or phase separate) from the matrix polymer. The resulting layer was smooth, clear, transparent and free of any textured appearance.

EXAMPLE IV

A photoconductive imaging member having two electrically operative layers was fabricated using the same procedures and materials as described in Example II, except that the high molecular weight poly(dimethylsiloxane) content in the 24 micrometers dry thickness charge transport layer was 3 weight percent based on the total weight of the dried charge transport layer. Since the dissolved high molecular weight poly(dimethylsiloxane) precipitated out (or phase separated) from the matrix polymer to form small spheres of about 1 to 2 micrometers in size, the resulting charge transport layer was clear and transparent and had a textured surface morphology.

EXAMPLE V

A control photoconductive imaging member having two electrically operative layers was fabricated using the same procedures and materials as described in Example III, except that the low molecular weight polydimethylsiloxane-polycarbonate block copolymer content in the 24 micrometers dry thickness charge transport layer was 3 weight percent based on the total weight of the dried charge transport layer. The dissolved polydimethylsiloxane-polycarbonate block copolymer blended with the matrix polymer and did not precipitate out (or phase separate). The resulting layer was smooth, clear, transparent and free of any textured appearance.

EXAMPLE VI

A photoconductive imaging member having two electrically operative layers was fabricated using the same procedures and materials as described in Example II, except that the high molecular weight poly(dimethylsiloxane) content in the 24 micrometers dry thickness charge transport layer was 5 weight percent based on the total weight of the dried charge transport layer. Since the dissolved high molecular weight poly(dimethylsiloxane) precipitated out (or phase separated) from the matrix polymer to form small spheres of about 1 micrometer in size, the resulting charge transport layer was clear and transparent, but had a textured surface morphology.

EXAMPLE VII

A control photoconductive imaging member having two electrically active layers was fabricated using the same procedures and materials as described in Example III, except that the low molecular weight polydimethylsiloxane-polycarbonate block copolymer content in the 24 micrometers dry thickness charge transport layer was 5 weight percent based on the total weight of the dried charge transport layer. There was a slight phase separation of some of the dissolved polydimethylsiloxane-polycarbonate block copolymer from the continuous matrix material of the charge transport layer. Although the resulting dried layer had a smooth outer surface, it had a slightly hazy appearance.

EXAMPLE VIII

The photoconductive imaging members of Examples I through VII were examined for plywood interference fringes development using coherent light emitted from a low pressure sodium lamp (available from American Electric Company). The results through visual observation are set forth in Table I below:

TABLE I

| Example | Plywood Fringes Formation |
|---|---|
| I Control | Yes |
| II | Slight |
| III Control | Yes |
| IV | No |
| V Control | Yes |
| VI | No |
| VII Control | Slight |

EXAMPLE IX

The photoconductive imaging members of Examples I through VII were evaluated for surface contact adhesion by applying a 1.3 cm (½ inch) width Scotch brand Magic Tape #810, available from 3M Company, over the charge transport layer of each imaging sample for a peel test measurement. The step by step procedures used for a 180° tape peel measurement are as follows:

a) Prepare a 2.54×0.16×7.62 cm (1"×1/16"×3") aluminum (Al) backing plate.
b) Place a double sided adhesive tape over the Al backing plate to facilitate photoreceptor sample mounting. For successful peel measurement, the selected double sided tape should have a 180° adhesive peel strength of at least 900 gm/cm with both the Al plate and with the test photoreceptor sample.
c) Cut a piece of test specimen of 2.54×15.24 cm (1.0"×6") from each imaging sample and apply a 1.3 cm (½") width Scotch brand Magic Tape #810 onto the outer surface of the charge transport layer of the test specimen of each imaging member.
d) For the tape peel measurement, press the test specimen (bearing the applied Scotch brand Magic Tape) with its back side against the double sided tape/Al backing plate. Ensure that the lower edge of the specimen is positioned evenly with the bottom of the plate.
e) Insert the test specimen with the Al backing plate into the jaws of an Inston Tensile Tester and it is ready for 180° tape peel measurement.

f) Set the load range of the Instron chart recorder at 500 grams full scale for a 180° tape peel measurement. With the jaw crosshead speed at 2.54 cm/min (1"/min) and the chart speed at 5.08 cm/min (2"/min), peel the tape at least 5.08 cm (2") off from the charge transport layer surface.

The tape/charge transport layer surface contact adhesion strength was calculated using the equation given below and the results obtained were tabulated in Table II:

$$ADHESN = L/W, \text{ gm/cm}$$

where:

ADHESN = 180° tape peel strength, gm/cm

L = average load, gm

W = Width of the applied tape over the test sample, cm

TABLE II

| Example | 180° Peel Strength (gm/cm) |
|---|---|
| I Control | 455 |
| II | 30 |
| III Control | 200 |
| IV | 23 |
| V Control | 115 |
| VI | 21 |
| VII Control | 100 |

This data indicates that the surface energy of the charge transport layer of this invention, as reflected by the reduction of tape peel strength, was greatly reduced to improve blade/imaging member surface cleaning efficiency during cyclic xerographic processes.

EXAMPLE X

A coefficient of friction test was conducted by fastening the photoconductive imaging member of control Example I, with its charge transport layer (having no additive) facing upwardly, to a platform surface. A polyurethane elastomeric cleaning blade was then secured to the flat surface of the bottom of a horizontally sliding plate weighing 200 grams. The sliding plate was dragged in a straight line over the platform, against the horizontal test imaging sample surface, with the surface of the cleaning blade facing downwardly. The sliding plate was moved by a thin cable which had one end attached to the plate and the other end threaded around a low friction pulley and fastened to the jaws of an Instron Tensile Tester. The pulley was positioned so that the segment of the cable between the weight of the sliding plate and the pulley was parallel to the surface of the flat horizontal test surface. The cable was pulled vertically upward from the pulley by the jaw of the Instron Tensile Tester and the load required to cause the cleaning blade to slide over the charge transport layer surface was monitored with a chart recorder. The coefficient of friction test for the charge transport layer against the cleaning blade was repeated again as described above, except that the photoconductive imaging member of control Example I was replaced with each of the imaging samples of Examples II through VII using fresh blades for each test.

The photoconductive imaging members of Examples I, II, IV and VI were cut to a size of 2.54 cm by 30.5 cm (1 inch by 12 inches) and tested for resistance to wear. Testing was effected by means of a dynamic mechanical cycling device in which glass tubes were skidded across the surface of the charge transport layer on each photoconductive imaging member. More specifically, one end of the test sample was clamped to a stationary post and the sample was looped upwardly over three equally spaced horizontal glass tubes and then downwardly through a generally inverted "U" shaped path with the free end of the sample secured to a weight which provided one pound per inch width tension on the sample. The face of the imaging member bearing the charge transport layer was facing downwardly such that it was allowed to contact the glass tubes. The glass tubes each had a diameter of 2.54 cm (one inch). Each tube was securely fixed at each end to an adjacent vertical surface of a pair of disks that were rotatable about a shaft connecting the centers of the disks. The glass tubes were parallel to and equidistant from each other and equidistant from the shaft connecting the centers of the disks. Although the disks were rotated about the shaft, each glass tube was rigidly secured to the disk to prevent rotation of the tubes around each individual tube axis. Thus, as the disk rotated about the shaft, two glass tubes were maintained at all times in sliding contact with the surface of the charge transport layer. The axis of each glass tube was positioned about 4 cm from the shaft. The direction of movement of the glass tubes along the charge transport layer surface was away from the weighted end of the sample toward the end clamped to the stationary post. Since there were three glass tubes in the test device, each complete rotation of the disks was equivalent to three wear cycles in which the surface of the charge transport layer was in sliding contact with a single stationary support tube during testing. The rotation of the spinning disks was adjusted to provide the equivalent of 28.7 cm (11.3 inches) per second tangential speed. The extent of the charge transport layer wear was measured using a permascope and expressed as the amount of thickness change at the end of 330,000 wear cycles of testing.

The results obtained for coefficient of friction and wear resistance tests are listed in Table III below and show that the charge transport layers of this invention having 1, 3 and 5 weight percent high molecular weight polydimethylsiloxane incorporated therein achieve a large reduction in coefficient of surface contact friction when rubbed against the polyurethane cleaning blade as well as an improvement in wear resistance against a glass skid plate when compared to the control imaging member of Example I. At low loading levels of 1 and 3 percent, the extent of reduction in coefficient of friction and enhancement of wear resistance was seen to substantially depend on the amount of high molecular weight polydimethylsiloxane added to the charge transport layer. This dependence was, however, only slightly noticeable for the 3 and 5 weight percent levels of high molecular weight polydimethylsiloxane content.

TABLE III

| Example | Coeff. of Friction Against Blade | Thickness Change After 330,000 Wear Cycles (Micrometers) |
|---|---|---|
| I Control | 3.9 | −11.5 |
| II | 1.5 | −7.0 |
| III Control | 3.7 | — |
| IV | 0.7 | −5.3 |
| V Control | 3.4 | — |
| VI | 0.5 | −4.4 |
| VII Control | 2.5 | — |

EXAMPLE XI

The electrical properties of the photoconductive imaging samples prepared according to Examples I, II, IV and VI were evaluated with a xerographic testing scanner comprising a cylindrical aluminum drum having a diameter of 24.26 cm (9.55 inches). The test samples were taped onto the drum. When rotated, the drum carrying the samples produced a constant surface speed of 76.3 cm (30 inches) per second. A direct current pin corotron, exposure light, erase light, and five electrometer probes were mounted around the periphery of the mounted photoreceptor samples. The sample charging time was 33 milliseconds. Both expose and erase lights were broad band white light (400–700 nm) outputs, each supplied by a 300 watt output Xenon arc lamp. The relative locations of the probes and lights are indicated in Table IV below:

TABLE IV

| Element | Angle (Degrees) | Position | Distance From Photoreceptor |
|---|---|---|---|
| Charge | 0 | 0 | 18 mm (Pins)<br>12 mm (Shield) |
| Probe 1 | 22.50 | 47.9 mm | 3.17 mm |
| Expose | 56.25 | 118.8 | N.A. |
| Probe 2 | 78.75 | 166.8 | 3.17 mm |
| Probe 3 | 168.75 | 356.0 | 3.17 mm |
| Probe 4 | 236.25 | 489.0 | 3.17 mm |
| Erase | 258.75 | 548.0 | 125 mm |
| Probe 5 | 303.75 | 642.9 | 3.17 mm |

The test samples were first rested in the dark for at least 60 minutes to ensure achievement of equilibrium with the testing conditions at 40 percent relative humidity and 21° C. Each sample was then negatively charged in the dark to a development potential of about 900 volts. The charge acceptance of each sample and its residual potential after discharge by front erase exposure to 400 ergs/cm$^2$ were recorded. The test procedure was repeated to determine the photo induced discharge characteristic (PIDC) of each sample by different light energies of up to 20 ergs/cm$^2$. The 50,000 cycle electrical testing results obtained for the test samples of Examples I, II, IV and VI are collectively tabulated in the following Table V.

TABLE V

| Element | Dark Decay Rate (V/sec) | Residual Potential (V) | 50K Cycles Cycle-down (V) |
|---|---|---|---|
| I (Control) | 150 | 9 | 55 |
| II | 151 | 8 | 55 |
| IV | 150 | 10 | 57 |
| VI | 151 | 8 | 58 |

The 50,000 cycles electrical data show that addition of high molecular weight polydimethylsiloxane in the range between 1 and 5 weight percent in the charge transport layer for test imaging samples of Examples II, IV and VI give essentially equivalent dark decay rate, residual voltage, PIDC and 50,000 cycles cycle-down when compared to the control imaging sample of Example I.

The mechanical and electrical cyclic results obtained for the test samples of Example II, IV and VI are of particular importance because they indicate that incorporation of high molecular weight polydimethylsiloxane of the present invention into the charge transport layer not only improves the desired mechanical and frictional properties of the resulting charge transport layer, it also maintains the crucial electrical integrity of each photoconductive imaging member.

It is should also be emphasized that incorporation of high molecular weight polydimethylsiloxane in the charge transport layers of this invention as described in Examples II, IV and VI, at loading levels from about 1 to about 5 weight percent, did not alter the optical clarity of the charge transport layer. The maintenance of light transmittance characteristics of this layer is essential to achieve proper photoelectric functions during xerographic imaging processing.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrostatographic imaging member comprising a supporting substrate and an outer layer on the imaging side of said imaging member, said outer layer comprising between about 0.1 percent and about 10 percent by weight, based on the total weight of said outer imaging layer, of minute spheres of a high molecular weight, pseudo solid polysiloxane homopolymer homogeneously dispersed in a continuous film forming polymer matrix, said polysiloxane homopolymer having a weight average molecular weight between about 200,000 and about 800,000.

2. An electrostatographic imaging member member according to claim 1 comprising said supporting substrate, a charge generating layer and said outer layer, said outer layer comprising said continuous film forming polymer phase, said spheres of polysiloxane and a charge transport material dissolved in or molecularly dispersed in said continuous film forming polymer matrix.

3. An electrostatographic imaging member according to claim 1 wherein said outer layer is an overcoating layer.

4. An electrostatographic imaging member according to claim 1 wherein said outer layer is a charge generation layer.

5. An electrostatographic imaging member according to claim 1 wherein said outer layer is a dielectric imaging layer of an electrographic imaging member.

6. An electrostatographic imaging member according to claim 1 wherein said outer imaging layer is a photoconductive layer of an electrophotographic imaging member.

7. An electrostatographic imaging member according to claim 1 wherein said outer imaging layer is an electrically conductive ground strip layer.

8. An electrostatographic imaging member according to claim 1 wherein said spheres have an average particle size of between about 0.05 micrometer and about 10 micrometers.

9. An electrostatographic imaging member according to claim 1 wherein said spheres have an average size between about 0.1 and about 6 micrometer

10. An electrostatographic imaging member member according to claim 1 wherein said high molecular weight polysiloxane has a backbone of repeating —Si—O— units.

11. An electrostatographic imaging member according to claim 1 wherein said outer layer comprises between about 0.5 percent and about 7 percent by weight of said polysiloxane based on the total weight of said outer imaging layer.

12. An electrostatographic imaging member according to claim 1 wherein said outer layer comprises between about 1 percent and about 5 percent by weight of said polysiloxane based on the total weight of said outer imaging layer.

13. An electrostatographic imaging member according to claim 1 wherein said high molecular weight polysiloxane is represented by the following formula:

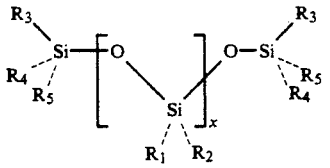

wherein the value of x is sufficient to form a high molecular weight polymer having a weight average molecular weight between about 200,000 and about 800,000, $R_1$ and $R_2$ are organic pendent groups independently selected from the group consisting of substituted or unsubstituted alkyl groups containing 1 to 22 carbon atoms such as methyl, and ethyl and octadecyl; substituted or unsubstituted phenyl groups; glycidoxy; and vinyl, methacryloxy and $R_3$, $R_4$ and $R_5$ are independently selected from the group consisting of unsubstituted or halogen substituted organic groups including alkyl groups containing 1 to 22 carbon atoms, and phenyl groups.

14. An electrostatographic imaging member according to claim 1 wherein said outer layer has a textured outer surface.

15. An electrostatographic imaging member according to claim 14 wherein said textured outer surface comprises minute spheres of said polysiloxane adjacent the outer surface of said outer layer partially protruding to distance of between about 0.01 micrometer and about 0.1 micrometer above said outer surface of said outer layer.

16. An electrostatographic imaging process comprising providing an electrostatographic imaging member having an imaging surface, said imaging member comprising a supporting substrate and an outer layer on the imaging surface side of said imaging member, said outer layer comprising between about 0.1 percent and about 10 percent by weight, based on the total weight of said outer imaging layer, of minute spheres of a high molecular weight, pseudo solid polysiloxane homopolymer homogeneously dispersed in a continuous film forming polymer matrix, said polysiloxane homopolymer having a weight average molecular weight between about 200,000 and about 800,000, forming an electrostatic latent image on said imaging surface, developing said electrostatic latent image with marking particles to form marking particle images in conformance with said electrostatic latent image, transferring said marking particle images to a receiving member, cleaning said imaging surface and repeating said electrostatic latent image forming, developing, transferring and cleaning steps at least once.

17. An electrostatographic imaging process according to claim 16 including cleaning said imaging surface with a cleaning blade in frictional contact with said imaging surface.

18. A process for preparing an electrostatographic imaging member comprising providing at least a supporting substrate, applying an outer layer coating solution comprising a dissolved film forming polymer to form a wet outer layer, a dissolved high molecular weight polysiloxane homopolymer having a weight average molecular weight between about 200,000 and about 800,000 and a solvent for said film forming polymer and said polysiloxane, and drying said wet outer layer to remove said solvent whereby a dried outer layer is formed comprising a continuous matrix of said film forming polymer and between about 0.1 percent and about 10 percent by weight, based on the total weight of said dried outer layer, of minute pseudo solid spheres of said polysiloxane homopolymer homogeneously dispersed in said continuous matrix of said film forming polymer

19. A process according to claim 18 wherein said coating solution also contains a dissolved charge transporting material.

* * * * *